US006494016B1

(12) United States Patent
Bankson

(10) Patent No.: US 6,494,016 B1
(45) Date of Patent: Dec. 17, 2002

(54) INSTALLATION DEVICE FOR INSTALLING SIDING AND METHOD THEREFOR

(75) Inventor: Jeffrey R. Bankson, 75 Burnt Mills Rd., Goose Creek, SC (US) 29445

(73) Assignee: Jeffrey R. Bankson, Goose Creek, SC (US)

( * ) Notice: Subject to any disclaimer, the term of this patent is extended or adjusted under 35 U.S.C. 154(b) by 0 days.

(21) Appl. No.: 09/692,130

(22) Filed: Oct. 19, 2000

(51) Int. Cl.[7] ..... E04D 15/00

(52) U.S. Cl. ..... 52/749.1; 33/187; 33/647; D10/64; 52/127

(58) Field of Search ..... 52/DIG. 1, 749.12; 33/646, 647

(56) References Cited

U.S. PATENT DOCUMENTS

| | | | | | |
|---|---|---|---|---|---|
| 316,338 | A | * | 4/1885 | Davis | |
| 1,115,202 | A | * | 10/1914 | Ingles | |
| 4,155,175 | A | * | 5/1979 | Stiles | 33/187 |
| 4,314,429 | A | * | 2/1982 | Casteel et al. | 52/127 |
| D362,812 | S | * | 10/1995 | Meyer | D10/64 |
| 5,465,499 | A | * | 11/1995 | LaPlante | 33/647 |

* cited by examiner

*Primary Examiner*—Carl D. Friedman
*Assistant Examiner*—Steve M Varner
(74) *Attorney, Agent, or Firm*—Merchant & Gould P.C.

(57) ABSTRACT

A device allowing a sole installer to install overlapping board siding on a wall is described. The device includes an s-shaped hanger having a u-shaped portion and an inverted u-shaped portion sharing a common leg. A handle extends horizontally from the lower portion of said hanger, substantially perpendicular to the common leg. To install the siding, the installer hangs the first board run. Next, the inverted u-shaped portion of the s-shaped hanger is placed over a first board of the first board run and a second board to be installed is fitted within the u-shaped portion of the s-shaped hanger. The installer fastens the far end of the second board using a single fastener so that the second board can pivot about the fastener. The installer returns to the first end and pivots the second board to free the hanger. The installer rotates the hanger so that the common leg fits under the first board and the handle extends upwardly parallel to the side of the wall. The installer positions the lower edge of the second board at the upper edge (distal end) of the handle, thus placing the second board so as to ensure the desired overlap between boards. The installer then removes the device and fastens the first end in place. The entire board length then can be nailed as needed and the installer continues with the next board. The handle may be adjustable to accommodate different overlaps and/or different widths of boards.

12 Claims, 3 Drawing Sheets

INSTALLATION DEVICE FOR INSTALLING SIDING AND METHOD THEREFOR

BACKGROUND OF THE INVENTION

The invention relates to a device for installing siding and, more particularly, a device facilitating installation of board siding, such as hard board siding boards, by a sole installer. The invention further relates to a method of installing or "hanging" such boards using the device.

SUMMARY OF INVENTION

Installation of lap siding typically requires at least two people; that is, at least one person at each end of the length of board. As used herein, "board" siding includes, but is not limited to, hard board or concrete-based siding, as well as cedar, cypress, spruce or any other wood siding that is installed with each board run overlapping the one below it. An example of a hard board siding for which the present invention is particularly useful is Hardiplank® concrete-based siding boards, manufactured by James Hardie Siding Products, 26300 La Alameda, Suite 250, Mission Viejo, California 92691. The boards may be of any reasonable length, a variety of thicknesses, typically up to ¾ inch and a variety of board widths, typically 5–12 inches.

To install siding boards, the initial board run is fastened to the lowermost portion of the wall. Subsequent board runs are added above the initial run along the height of the wall so that each board run overlaps the board run below it. Conventionally, at least two installers are required per job, one installer at each end of a board, which increases labor costs and sometimes presents scheduling difficulties. Moreover, scaffolding is required once the board run is sufficiently high that the installers cannot conveniently reach it from the ground. The weight of two installers plus the board can easily exceed the 250–300 pound rating for the standard scaffolding used in the siding industry, thus necessitating more substantial and more costly scaffolding.

The present invention overcomes the above difficulties, allowing a sole installer to install the siding, thus reducing labor costs and scheduling difficulties. Importantly, the invention also increases productivity, since sole installers can work on different portions of the job simultaneously, substantially reducing installation time.

The invention preferably includes a substantially s-shaped hanger. The s-shaped hanger includes an upper, substantially inverted u-shaped portion and a lower substantially u-shaped portion (the u-shaped portions share a common leg so that the overall shape is that of an "s"). A handle extends from an end of the lower u-shaped portion in a direction generally perpendicular to the common leg. The length of the handle is selected to correspond to the desired overlap or "reveal" between boards, in a manner that will become more apparent below.

To install the siding, the installer hangs the first board run (only this initial step may require two people). Next, the upper, substantially inverted u-shaped portion is hung over the lowermost board at one end of the board run and a new board to be installed is fitted within the u-shaped channel formed by the lower portion of the s-shaped hanger. The installer then fastens the other end of the new board with a single nail so that the board can pivot about the nail.

The installer then returns to the first end and rotates the board, freeing the device for removal The installer rotates the device so that the common leg fits under the first board and the handle extends upwardly parallel to the side of the building. The installer positions the lower edge of the new board at the upper edge (distal end) of the handle, thus placing the new board correctly to ensure the desired overlap or reveal between boards, and nails the first end of the new board in place. The installer follows this procedure with each subsequent board run until the siding is completed.

The length of the handle may be adjustable so that a single device may accommodate different overlaps and/or different board widths. To this end, the body of the handle preferably is slotted longitudinally. A sleeve having a bolt disposed vertically therein surrounds the handle. The bolt is fitted within the slot in the handle and held therein by a nut. In this way, when the nut is loosened, the sleeve can slide longitudinally along the slot in the handle, varying the length of the handle.

DETAILED DESCRIPTION OF THE PREFERRED EMBODIMENTS

A device according to the present invention is shown in FIGS. 1–4. Throughout the description, like numerals will be used to identify like elements.

Figure 1:
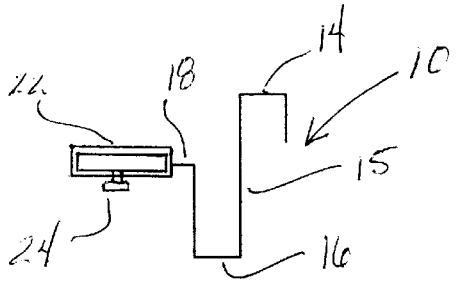
FIG. 1 is a side elevational view of the right side of the device according to the present invention.
Figure 2:
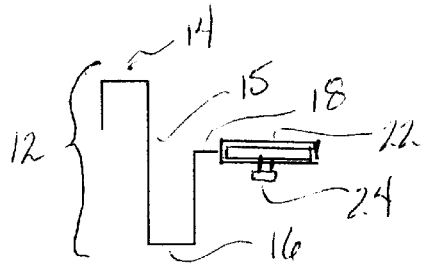
FIG. 2 is a left side elevational view of the device shown in FIG. 1.

As shown in FIG. 1, siding installation device 10 according to the present invention includes a substantially s-shaped hanger 12 having an upper, substantially inverted u-shaped portion 14 and a lower substantially u-shaped portion 16 coupled by a common leg 15. Hanger 12 is preferably formed of a steel strip ⅛ of an inch thick, although it is to be understood that other materials and different thicknesses may be used depending on the type and weight of siding boards to be installed. Each u-shaped portion is designed to accommodate the width of a siding board therein.

A handle 18 extends horizontally from an upper distal end of lower portion 16 in a direction substantially perpendicular to common leg 15. The length of the handle preferably is adjustable to accommodate varying lengths of overlap or "reveal" and/or width of boards. An overlap of 1¼ inches is typical for most board siding, although different overlaps may be chosen depending on particular applications and aesthetic tastes. Of course, non-adjustable handles may be used, in which case different devices would be used for different overlaps and/or board widths, in a manner that will become more apparent below.

Figure 3:
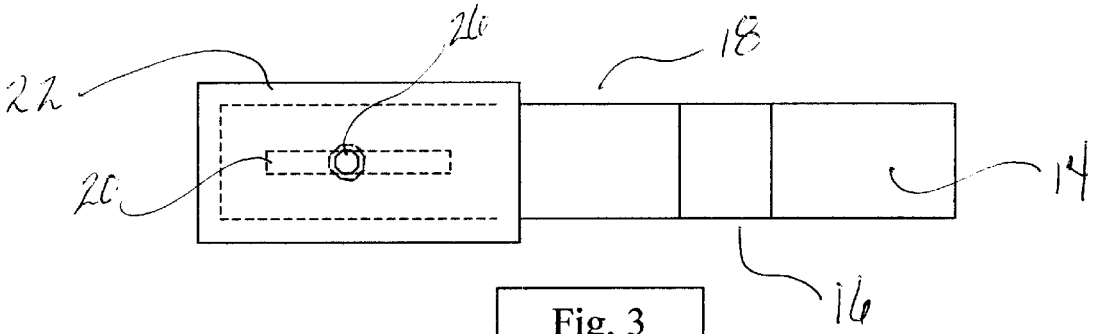
FIG. 3 is an enlarged planar top view of the device shown in FIG. 1.
Figure 4:
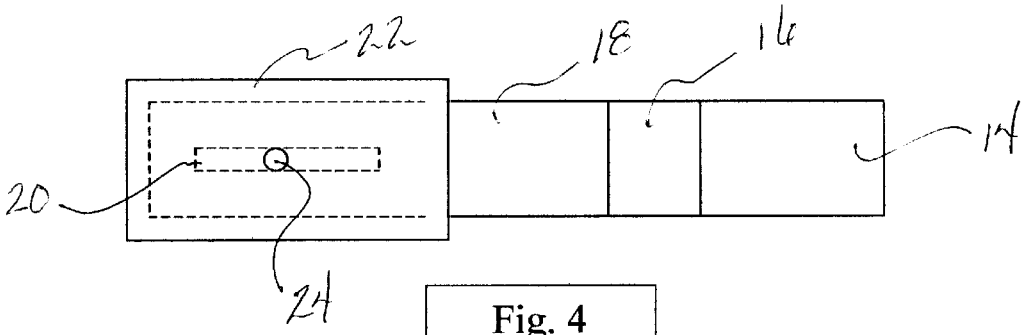
FIG. 4 is an enlarged planar bottom view of the device shown in FIG. 1.

One preferred arrangement facilitating adjustment of the handle is shown in FIGS. 3 and 4. Handle 18 preferably includes a slot 20 disposed longitudinally along the length of its body. Sleeve 22 is fitted around handle 18. Sleeve 22 includes a securing mechanism, such as a bolt 24, disposed vertically within slot 20. A locking mechanism, such as a nut 26, is used to lock the sleeve in place. When locking mechanism 26 is unlocked, in this case, loosened, sleeve 22 is free to slide along the length of handle 18.

It is envisioned that sleeve 22 may be slideably fitted around the body of handle 18 in any number of other ways. For example, instead of slot 20, bolt 24 and nut 26, a series of holes may be disposed along a line running longitudinally along handle 18 and sleeve 22 may contain a spring-loaded pin. By pushing the pin inwardly, the sleeve may be allowed to slide along the length of the handle and, when the sleeve is properly placed, the pin may be released into a corresponding hole. Alternatively, the sleeve may be spring-biased longitudinally along the length of the handle with a locking mechanism used to lock the sleeve in place. These are exemplary only and other arrangements may be used within the scope of the invention as defined by the appended claims.

Figure 6D:
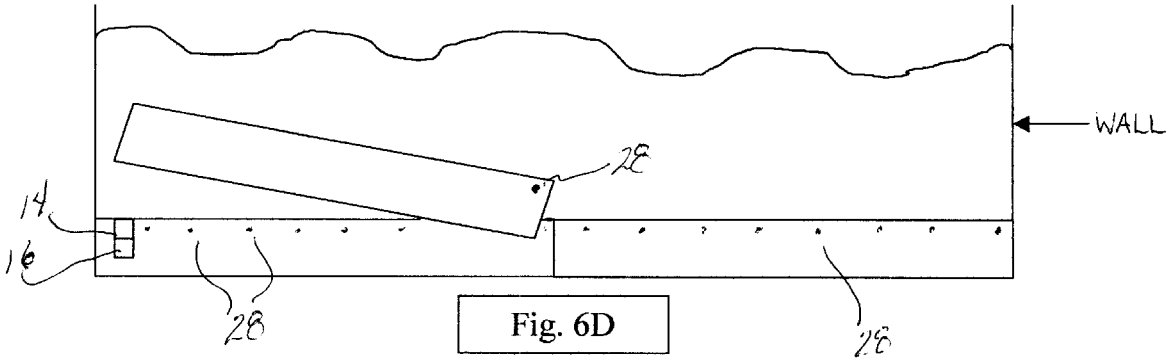
FIGS. 6A–6E show the steps of installing a length of board siding according to the present invention.
Figure 6E:
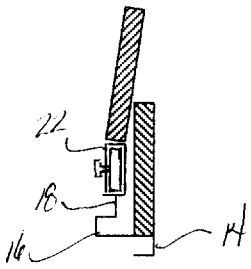
Figure 5:
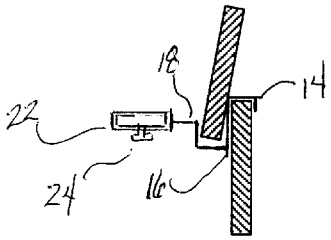
FIG. 5 is a right side elevational view showing the device fitted between an installed board and a new board according to the present invention.
Figure 6A:
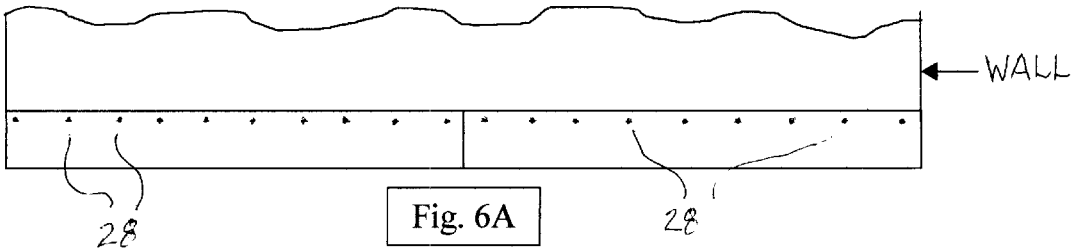
Figure 6B:
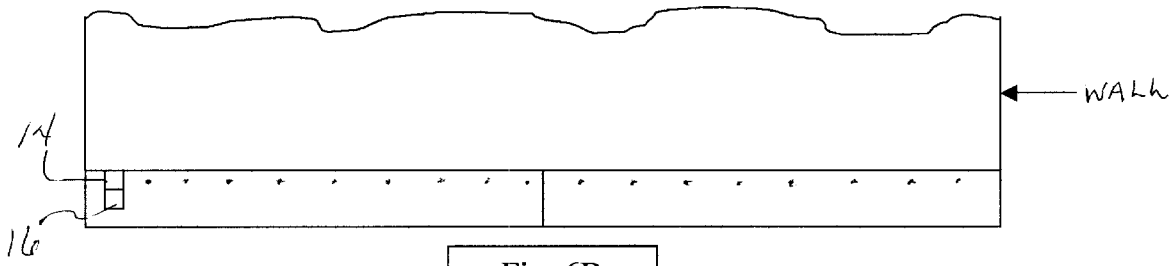

The method of installation can be seen in FIGS. 5 and 6A–6E. To install the siding, the installer hangs the first board run by fastening the lowermost siding board to the wall using fasteners 28, as shown in FIG. 6A. Next, upper, substantially inverted u-shaped portion 14 of s-shaped hanger 12 is hung over the lowermost board at one end of the board run and a new board to be installed is fitted within the lower substantially u-shaped portion 16 of the s-shaped hanger, as shown in FIGS. 5 and 6B.

Figure 6C:
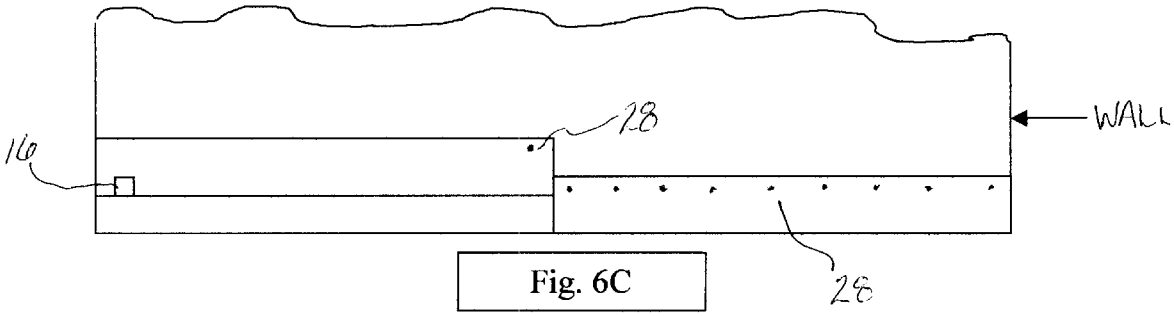

As shown in FIG. 6C, the installer fastens the free end of the board (the end not held by device 10) into the wall with a single fastener, such as a nail, so that the board can pivot about the nail. (The free end of the board is positioned at a location pre-marked on the wall. Only a single column of marks is needed; subsequent columns of board runs are aligned with the previous column.) It should be noted that while the fastener used in this description is a nail, any other suitable fastener might be used as would be understood by one of ordinary skill in the art.

The installer returns to the first end, rotates the board upwardly, thus freeing the device for removal, as shown in FIG. 6D. The installer rotates the device so that the common leg fits under the first board and the handle extends upwardly parallel to the side of the wall of the building. The installer positions the lower edge of the new board at the upper edge (distal end) of the handle, thus placing the new board correctly to ensure the desired overlap or reveal between boards, as shown in FIG. 6E. The installer fastens this end of the board in place and removes the device. The entire board length then can be nailed as needed and the installer continues with the next board.

In some instances, different amounts of overlap are desirable for a single siding job. In this case, the adjustable version of the invention makes it extremely convenient to change between one overlap and the other. As is evident from the above description, one board may be installed with the sleeve 22 locked in a first setting, while the next may be installed with the sleeve locked in a second setting. The adjustable version of the invention is also useful because it allows the installer to use the same device on different jobs requiring different overlaps.

The above is for illustrative purposes only. Modifications may be made, particularly with regard to size, shape and arrangement of parts, within the scope of the invention as defined in the appended claims.

I claim:

1. A device for installing overlapping siding boards on a wall, said device comprising:

a flange, a first end of said flange being shaped to hang over a lower siding board to fix said device in place, and a second end of said flange being shaped to accommodate an overlapping siding board therein; and a handle extending from said flange, with a movable sleeve surrounding said handle, said handle and said sleeve allowing the overlap between boards to be measured;

wherein said device holds the overlapping board so that a sole installer can install the siding boards.

2. A device as in claim 1, wherein said flange is substantially s-shaped, said first end being a substantially inverted u-shaped portion, said second end being a substantially u-shaped portion and wherein said u-shaped portion and said inverted u-shaped portion share a common leg.

3. A device as in claim 2, wherein said handle extends substantially perpendicular to said common leg.

4. A device as in claim 3, further comprising a series of holes disposed in a line along the length of said handle, a pin disposed in said sleeve and arranged so as to fit within any one of said series of holes, and a locking means for selectively locking said pin in place within a desired one of said holes.

5. A device as in claim 3, further comprising a longitudinal slot disposed in said handle and a bolt and corresponding nut disposed in said sleeve, so that the length of the handle may be adjustably selected by moving said sleeve longitudinally along said handle and then locked in a desired position.

6. A device as in claim 1, wherein said flange is made of steel.

7. A device as in claim 1, wherein said flange is made of ⅛-inch thick steel.

8. A tool permitting a sole installer to install lap board siding, said tool comprising:

a substantially s-shaped hanger having an inverted u-shaped portion that hangs on a first board run, a u-shaped portion that holds a second board for a second board run to be hung above said first board run, and a common leg shared by said u-shaped and inverted u-shaped portions;

a handle extending from said u-shaped portion in a direction substantially perpendicular to said common leg; and means for selectively adjusting the length of said handle, wherein the length of said handle is chosen to correspond to the desired amount of overlap between adjacent board runs.

9. A tool as claimed in claim 8, wherein said s-shaped hanger is made of ⅛-inch thick steel.

10. A tool as claimed in claim 8, wherein said means for selectively adjusting the length of said handle includes a sleeve disposed around said handle, a longitudinal slot within said handle and a corresponding locking mechanism disposed on said sleeve.

11. A tool as claimed in claim 10, wherein said locking mechanism includes a bolt and nut.

12. A tool as claimed in claim 10, wherein said locking mechanism includes a spring biased pin.

* * * * *